US012529525B2

(12) United States Patent
Morikami

(10) Patent No.: US 12,529,525 B2
(45) Date of Patent: Jan. 20, 2026

(54) HEAT DIFFUSION DEVICE

(71) Applicant: Murata Manufacturing Co., Ltd., Nagaokakyo (JP)

(72) Inventor: Masashi Morikami, Nagaokakyo (JP)

(73) Assignee: MURATA MANUFACTURING CO., LTD., Nagaokakyo (JP)

( * ) Notice: Subject to any disclaimer, the term of this patent is extended or adjusted under 35 U.S.C. 154(b) by 156 days.

(21) Appl. No.: 18/465,201

(22) Filed: Sep. 12, 2023

(65) Prior Publication Data

US 2024/0011717 A1 Jan. 11, 2024

Related U.S. Application Data

(63) Continuation of application No. PCT/JP2022/014906, filed on Mar. 28, 2022.

(30) Foreign Application Priority Data

Jun. 7, 2021 (JP) ..... 2021-095017

(51) Int. Cl.
*F28D 15/04* (2006.01)
*F28D 15/02* (2006.01)

(52) U.S. Cl.
CPC ..... *F28D 15/046* (2013.01); *F28D 15/0233* (2013.01)

(58) Field of Classification Search
CPC .... F28D 15/04; F28D 15/046; F28D 15/0266; F28D 15/0233; F28D 2021/0029; H01L 23/427; F28F 3/12
See application file for complete search history.

(56) References Cited

U.S. PATENT DOCUMENTS

2011/0108142 A1 5/2011 Liu et al.
2018/0372424 A1* 12/2018 Hurbi ..... F28D 20/025
2019/0113290 A1* 4/2019 Tseng ..... F28D 15/046
2020/0049420 A1* 2/2020 Liu ..... F28D 15/04
(Continued)

FOREIGN PATENT DOCUMENTS

JP S6383587 A 4/1988
JP 2002267378 A 9/2002
(Continued)

OTHER PUBLICATIONS

International Search Report in PCT/JP2022/014906, mailed May 24, 2022, 3 pages.

*Primary Examiner* — Tho V Duong
(74) *Attorney, Agent, or Firm* — ArentFox Schiff LLP

(57) ABSTRACT

A heat diffusion device including: a housing defining an internal space and that has a first inner wall surface and a second inner wall surface that face each other in a thickness direction; a working medium in the internal space; a first wick and a second wick in the internal space; and a partition wall that is gas-impermeable positioned in the internal space such that, in a plan view of the internal space in the thickness direction, the partition wall is interposed between the first wick and the second wick, and the partition wall has a first end portion and a second end portion, the second end portion of the partition wall being connected to an inner surface of the housing so as to define a vapor flow path between at least one of the first wick and the partition wall or the second wick and the partition wall.

20 Claims, 7 Drawing Sheets

(56) References Cited

U.S. PATENT DOCUMENTS

| | | | | |
|---|---|---|---|---|
| 2020/0080791 | A1* | 3/2020 | Yokoyama | F28D 15/04 |
| 2022/0034596 | A1 | 2/2022 | Haruki et al. | |

FOREIGN PATENT DOCUMENTS

| | | | | | |
|---|---|---|---|---|---|
| JP | 2008051407 | A | * | 3/2008 | F28D 15/046 |
| JP | 2011102691 | A | | 5/2011 | |
| JP | 2018185110 | A | | 11/2018 | |
| JP | 2019113270 | A | | 7/2019 | |
| JP | 2020106209 | A | | 7/2020 | |
| TW | M532046 | U | * | 11/2016 | F28D 15/046 |

* cited by examiner

HEAT DIFFUSION DEVICE

CROSS REFERENCE TO RELATED APPLICATIONS

The present application is a continuation of International application No. PCT/JP2022/014906, filed Mar. 28, 2022, which claims priority to Japanese Patent Application No. 2021-095017, filed Jun. 7, 2021, the entire contents of each of which are incorporated herein by reference.

TECHNICAL FIELD

The present invention relates to a heat diffusion device.

BACKGROUND ART

In recent years, there have been increases in amount of heat generation as a result of increases in integration density and performance level of elements. In addition, there have been increases in heat generation density as a result of reduction in sizes of products and thus it is important to take measures to dissipate heat. Such a situation is particularly conspicuous in the field of mobile terminals such as smartphones and tablets. A graphite sheet or the like is used as a member serving as a countermeasure against heat in many cases. However, since the graphite sheet is not sufficient in amount of heat transfer, using various members serving as countermeasures against heat has been investigated. Particularly, using a vapor chamber, which is a planar heat pipe, has been investigated since using the vapor chamber can result in very effective heat diffusion.

The vapor chamber has a structure in which a working medium and a wick that transfers the working medium by means of capillary attraction are encapsulated in a housing. The working medium absorbs heat from a heat generating element in an evaporation portion in which heat from the heat generating element is absorbed and after the working medium evaporates in the vapor chamber, the working medium moves to a condensation portion and is cooled to return to a liquid phase. The working medium that has returned to the liquid phase moves again to the evaporation portion on a heat generating element side due to the capillary attraction of the wick and cools the heat generating element. With repetition of the above-described process, the vapor chamber independently operates without external power and heat can be two-dimensionally diffused at a high speed by means of latent heat of evaporation and latent heat of condensation of the working medium.

Patent Document 1 discloses a heat dissipation module including: a container and a wick. The container encapsulates a working fluid and includes an evaporation portion in which the encapsulated working fluid is evaporated and a condensation portion in which the evaporated working fluid is condensed. The wick comes into contact with each of a pair of inner wall surfaces of the container facing each other and moves the condensed working fluid from the condensation portion to the evaporation portion by means of capillary attraction. A puddle flow path for the condensed working fluid is formed in a space surrounded by the pair of inner wall surfaces, a side surface of the wick that does not come into contact with the pair of inner wall surfaces, and a facing surface that is formed to be separated from the side surface of the wick.

In addition, Patent Document 1 discloses a heat dissipation module in which a plurality of wicks are disposed in a container (refer to FIG. 7 of Patent Document 1).

Patent Document 1: Japanese Unexamined Patent Application Publication No. 2019-113270

SUMMARY OF THE INVENTION

In the heat dissipation module (a heat diffusion device) as described in Patent Document 1, depending on the shape or the posture of the container, a puddle of the working fluid (a working medium) may be one-sided due to the effects of gravity. If the puddle is one-sided, there is a case where the working fluid (the working medium) cannot be collected by the wick. In addition, since the temperature around the puddle is low, the in-plane temperature uniformity of the heat dissipation module (the heat diffusion device) is one-sided.

If the working fluid (the working medium) cannot be collected by the wick, or if the in-plane temperature uniformity of the heat dissipation module (the heat diffusion device) is one-sided, there is a problem that the maximum amount of heat transfer decreases.

Although a method of increasing the number of wicks or routing one long wick to solve a problem that the working fluid (the working medium) cannot be collected by the wick is conceivable, it is not possible to solve a problem that the puddle is one-sided.

The present invention has been made to solve the above-described problems and an object thereof is to provide, by suppressing formation of a one-sided puddle depending on the shape or the posture of the heat diffusion device, a heat diffusion device in which the in-plane temperature uniformity is enhanced and the maximum amount of heat transfer becomes less likely to be decreased.

The present invention provides a heat diffusion device including: a housing that defines an internal space and has a first inner wall surface and a second inner wall surface that face each other in a thickness direction of the housing; a working medium encapsulated in the internal space; a first wick and a second wick in the internal space, wherein each of the first wick and the second wick has a portion that extends in a direction perpendicular to the thickness direction, and that abuts the first inner wall surface and the second inner wall surface of the housing; and a partition wall that is gas-impermeable positioned in the internal space such that, in a plan view of the internal space in the thickness direction, the partition wall is interposed between the first wick and the second wick, and the partition wall has a first end portion and a second end portion, the second end portion of the partition wall being connected to an inner surface of the housing so as to define a vapor flow path in the internal space of the housing between at least one of the first wick and the partition wall or the second wick and the partition wall.

According to the present invention, a heat diffusion device in which the in-plane temperature uniformity is enhanced and the maximum amount of heat transfer becomes less likely to be decreased is provided by suppressing formation of a one-sided puddle depending on the shape or the posture of the heat diffusion device.

1 is used with a right surface of a housing positioned on a lower side in a vertical direction.

Figure 5:
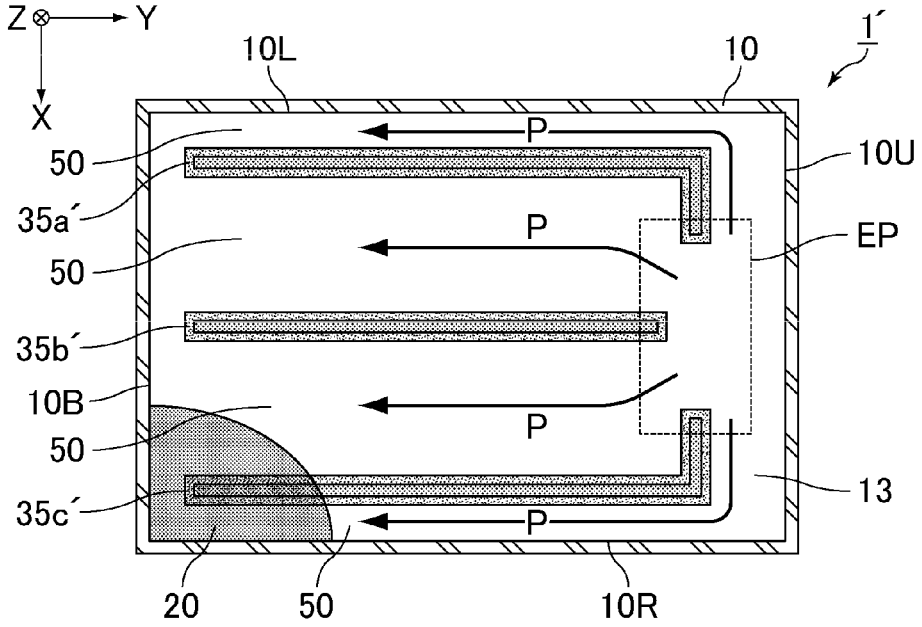

FIG. 5 is a sectional view schematically showing an example of a case where a vapor chamber in the related art is used with a right surface of a housing positioned on the lower side in the vertical direction.

Figure 6:
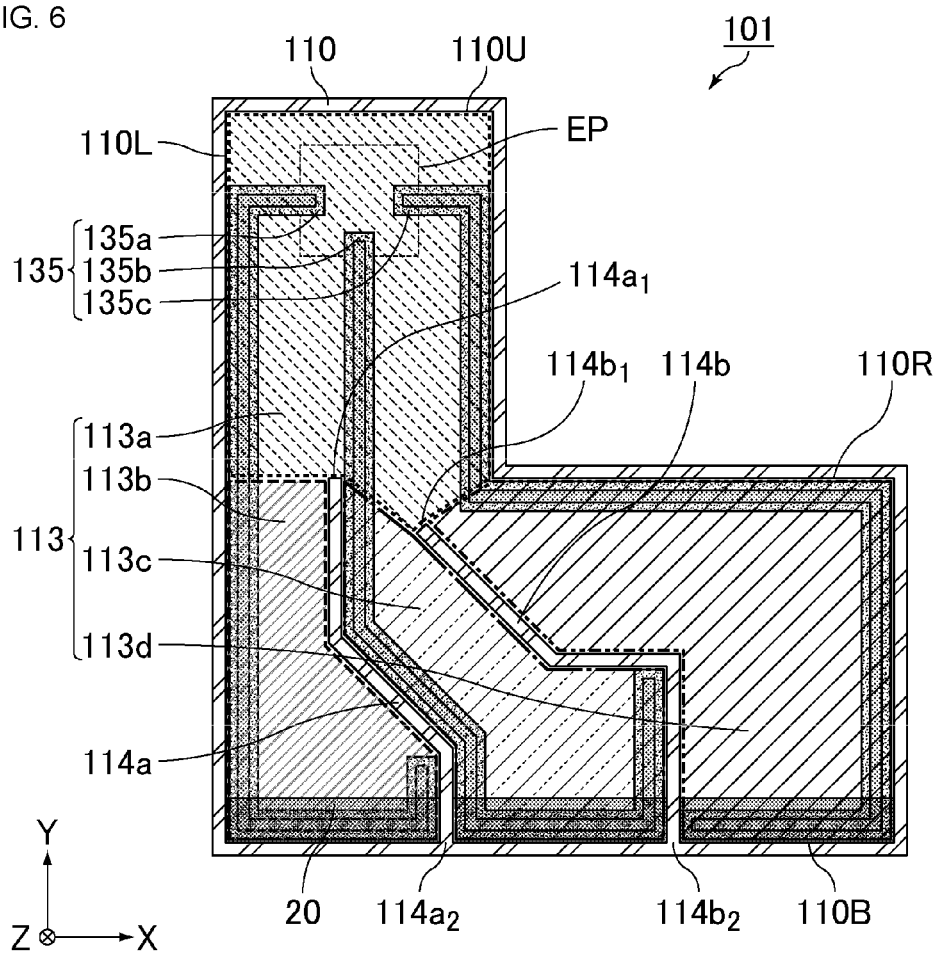

FIG. 6 is a sectional view schematically showing an example of a vapor chamber, which is a heat diffusion device according to a second embodiment of the present invention.

Figure 7:
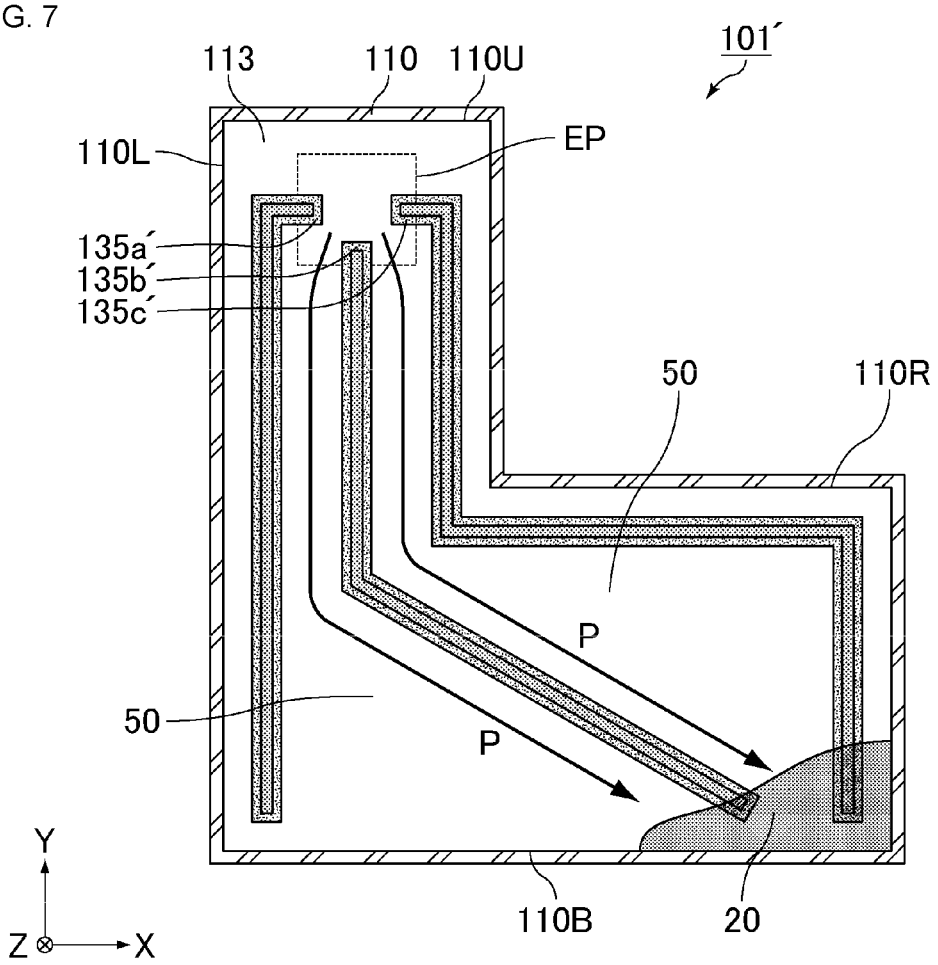

FIG. 7 is a sectional view schematically showing an example of an internal structure of a vapor chamber in the related art, in which a housing has an L-like shape.

Figure 8:
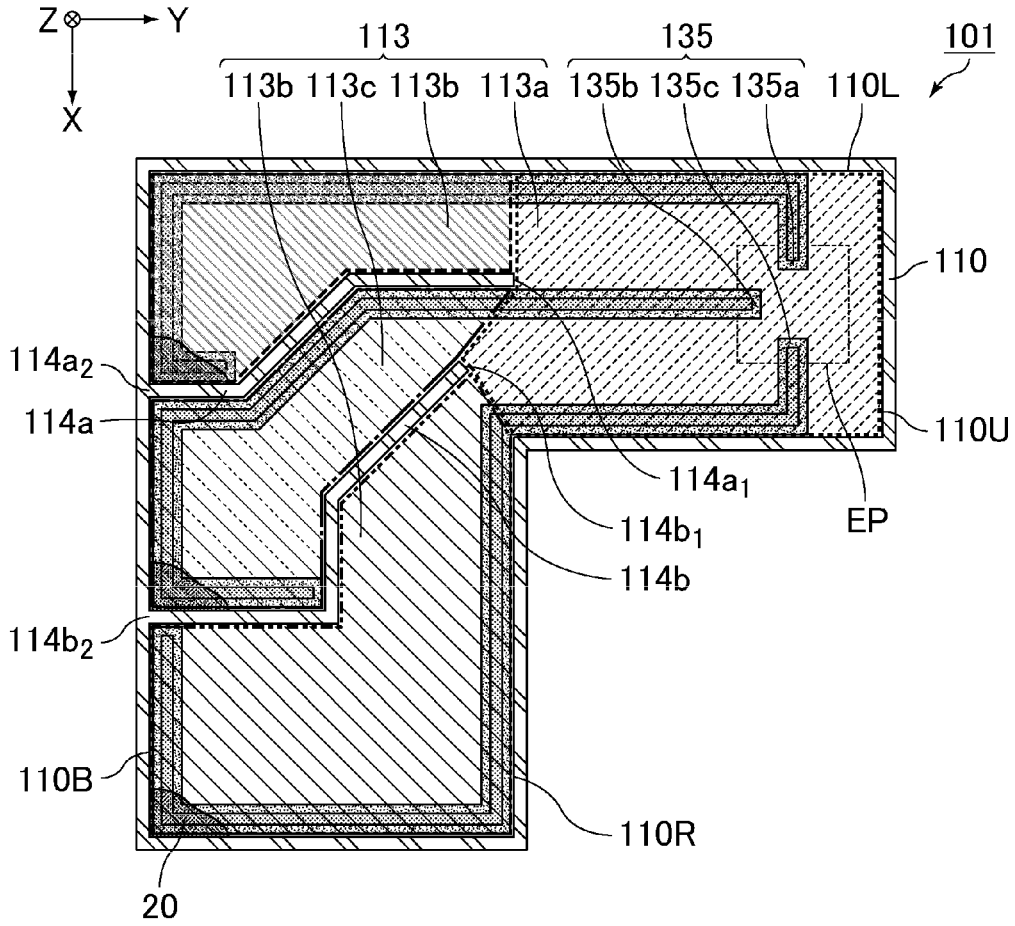

FIG. 8 is a sectional view schematically showing an example of a case where a vapor chamber, which is a heat diffusion device according to the second embodiment of the present invention, is used with a right surface of a housing positioned on the lower side in the vertical direction.

Figure 9:
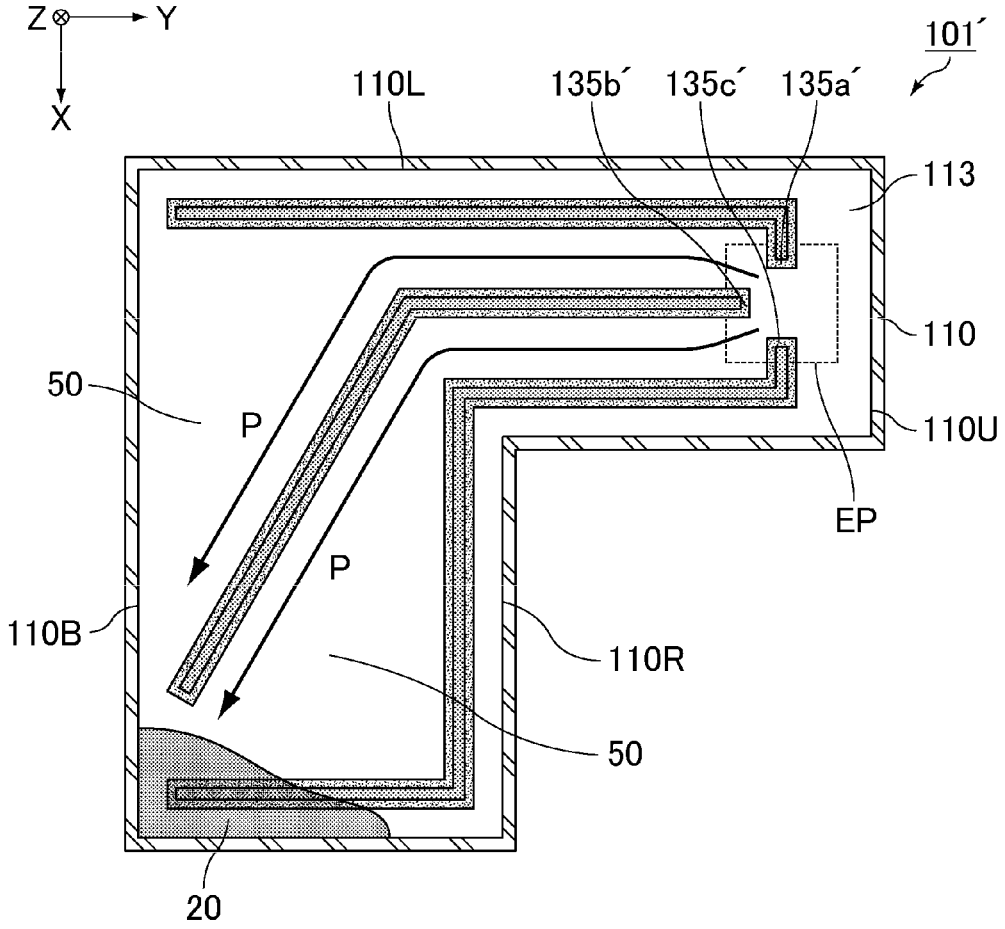

FIG. 9 is a sectional view schematically showing an example of a case where the vapor chamber in the related art in which the housing has the L-like shape is used with a right surface of the housing positioned on the lower side in the vertical direction.

Figure 10A:
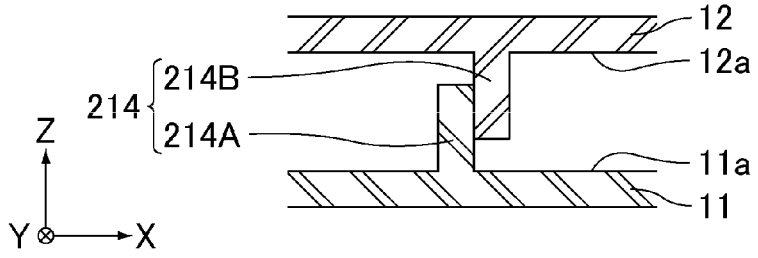

FIG. 10A is a sectional view schematically showing an example of a partition wall of a vapor chamber, which is a heat diffusion device according to the present invention.

Figure 10B:
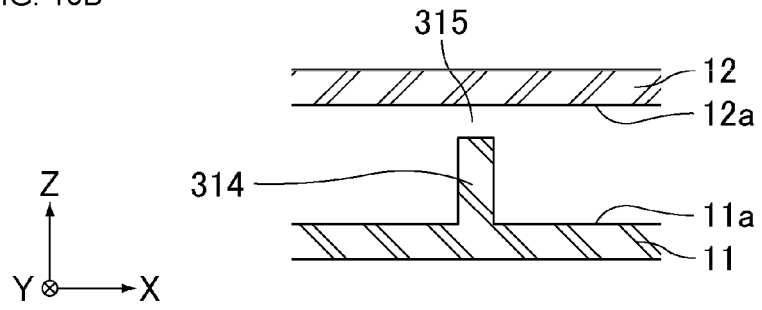

FIG. 10B is a sectional view schematically showing an example of a partition wall of the vapor chamber, which is the heat diffusion device according to the present invention.

Figure 10C:
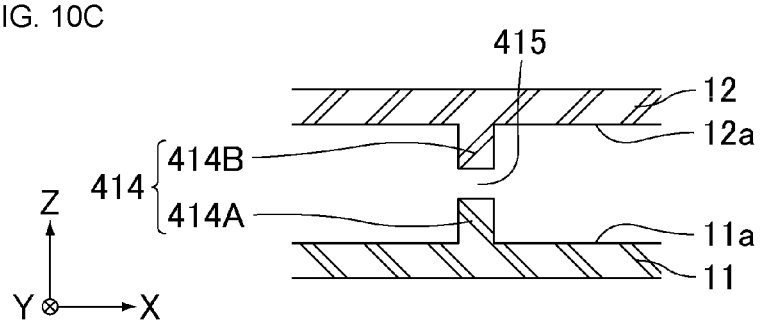

FIG. 10C is a sectional view schematically showing an example of a partition wall of the vapor chamber, which is the heat diffusion device according to the present invention.

Figure 10D:
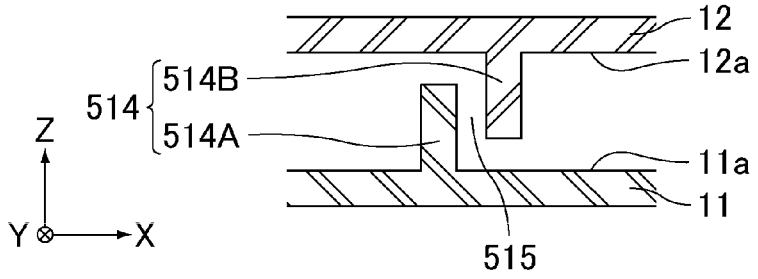

FIG. 10D is a sectional view schematically showing an example of a partition wall of the vapor chamber, which is the heat diffusion device according to the present invention.

DETAILED DESCRIPTION OF THE PREFERRED EMBODIMENTS

Hereinafter, a heat diffusion device of the present invention will be described.

However, the present invention is not limited to the following configurations, and can be applied after being appropriately modified without changing the gist of the present invention. Note that a combination of two or more of separate desired configurations of the present invention, which will be described below, is also the present invention.

The present invention provides a heat diffusion device including: a housing that defines an internal space and has a first inner wall surface and a second inner wall surface that face each other in a thickness direction of the housing; a working medium encapsulated in the internal space; a first wick and a second wick in the internal space, wherein each of the first wick and the second wick has a portion that extends in a direction perpendicular to the thickness direction, and that abuts the first inner wall surface and the second inner wall surface of the housing; and a partition wall that is gas-impermeable positioned in the internal space such that, in a plan view of the internal space in the thickness direction, the partition wall is interposed between the first wick and the second wick, and the partition wall has a first end portion and a second end portion, the second end portion of the partition wall being connected to an inner surface of the housing so as to define a vapor flow path in the internal space of the housing between at least one of the first wick and the partition wall or the second wick and the partition wall.

In the following description, in a case where embodiments are not to be distinguished in particular from each other, the heat diffusion device will be referred to as "a vapor chamber which is a heat diffusion device of the present invention" or "a vapor chamber of the present invention".

Hereinafter, specific embodiments of the heat diffusion device of the present invention will be described.

Each of the embodiments described below is merely an example, and it is a matter of course that it is possible to partially replace or combine configurations described in different embodiments. In second and subsequent embodiments, descriptions about matters common to a first embodiment will be omitted, and only differences will be described. Particularly, similar actions and effects achieved by similar configurations will not be repeatedly mentioned in each embodiment.

The drawings below are schematic, and dimensions, aspect ratios, and the like therein may be different from those of an actual product.

First Embodiment

Figure 1:
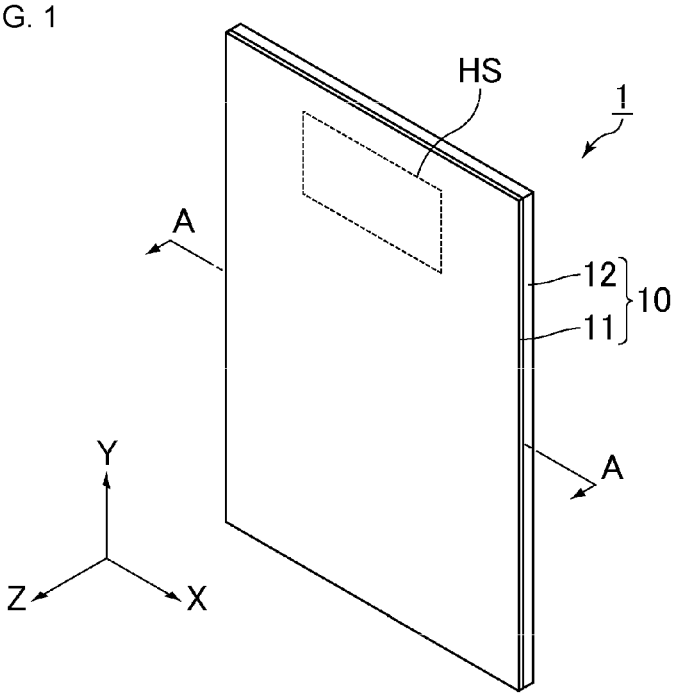
FIG. 1 is a perspective view schematically showing an example of a vapor chamber, which is a heat diffusion device according to a first embodiment of the present invention.

FIG. 1 is a perspective view schematically showing an example of a vapor chamber, which is a heat diffusion device according to a first embodiment of the present invention.

A vapor chamber 1 shown in FIG. 1 is provided with a hollow housing 10 that is airtightly closed. As shown in FIG. 1, a heat source HS, which is a heat generating element, is disposed on an outer wall surface of the housing 10. Examples of the heat source HS include electronic components of an electronic device, such as a central processing unit (CPU).

The vapor chamber 1 has a planar shape as a whole. That is, the housing 10 has a planar shape as a whole. Here, "planar shapes" include a plate-like shape and a sheet-like shape, and a "planar shape" means shape of which a dimension (hereinafter, will be referred to as the width) in a width direction X and a dimension (hereinafter, will be referred to as the length) in a length direction Y are considerably larger than a dimension (hereinafter, will be referred to as the thickness or the height) in a thickness direction Z. For example, a "planar shape" means a shape of which the width and the length are equal to or larger than ten times the thickness thereof, preferably equal to or larger 100 times the thickness thereof.

The size of the vapor chamber 1, that is, the size of the housing 10 is not particularly limited. The width and the length of the vapor chamber 1 can be appropriately set in accordance with the purpose of use of the vapor chamber 1. Each of the width and the length of the vapor chamber 1 is, for example, 5 mm to 500 mm, 20 mm to 300 mm, or 50 mm to 200 mm. The width and the length of the vapor chamber 1 may be the same as each other or different from each other.

When the vapor chamber has a shape other than a rectangular shape, the width and the length of the vapor chamber are determined as the maximum values in the width direction and the length direction.

The housing 10 is preferably composed of a first sheet 11 and a second sheet 12 that face each other with outer edge portions thereof being bonded to each other. The materials of the first sheet 11 and the second sheet 12 are not particularly limited as long as the sheets have characteristics (for example, thermal conductivity, strength, softness, and flexibility) suitable to be used as vapor chambers. The materials of the first sheet 11 and the second sheet 12 are preferably metal (for example, copper, nickel, aluminum, magnesium, titanium, iron, or an alloy containing those materials as main components) and particularly preferably copper. Although the materials of the first sheet 11 and the second sheet 12 may be the same as each other or different from each other, the materials are preferably the same as each other.

In a case where the housing 10 includes the first sheet 11 and the second sheet 12, the first sheet 11 and the second sheet 12 are bonded to each other at the outer edge portions thereof. As a bonding method, although there is no particular limit, laser welding, resistance welding, diffusion bonding, brazing, tungsten-inert gas welding (TIG welding), ultrasonic bonding, or resin bonding can be used, for example. Preferably laser welding, resistance welding, or brazing can be used.

Although the thicknesses of the first sheet 11 and the second sheet 12 are not particularly limited, the thicknesses are each preferably 10 μm to 200 μm, more preferably 30 μm to 100 μm, and still more preferably 40 μm to 60 μm. The thicknesses of the first sheet 11 and the second sheet 12 may be the same as each other or different from each other. In addition, each of the first sheet 11 and the second sheet 12 may be constant in thickness over the entire body, or may be partially thin.

The shapes of the first sheet 11 and the second sheet 12 are not particularly limited. For example, the first sheet 11 may have a flat plate-like shape of which the thickness is constant, and the second sheet 12 may have a shape of which the outer edge portion is thicker than a portion other than the outer edge portion.

Alternatively, the first sheet 11 may have a flat plate-like shape of which the thickness is constant, and the second sheet 12 may have a shape of which the thickness is constant and of which a portion other than the outer edge portion outwardly protrudes with respect to the outer edge portion. In this case, a recess is formed at an outer edge portion of the housing 10. Therefore, the recess of the outer edge portion can be used at a time of mounting the vapor chamber or the like. In addition, other components or the like can be disposed in the recesses of the outer edge portion.

Although the thickness of the entire vapor chamber 1 is not particularly limited, the thickness is preferably 50 μm to 500 μm.

The planar shape of the housing 10 as seen in the thickness direction Z is a rectangular shape of which a longitudinal direction is parallel to the length direction Y.

Note that the shape of the housing of the vapor chamber, which is the heat diffusion device according to the present invention, is not particularly limited and may be, for example, an L-like shape, a C-like shape (a U-like shape), a step-like shape, or the like.

In addition, the housing may have a space (a through-hole) inside the planar shape thereof. The planar shape of the housing may be a shape matching the purpose of use of the vapor chamber, the shape of a place where the vapor chamber is inserted, and other nearby components.

Next, the internal structure of the vapor chamber 1 will be described.

Figure 2:
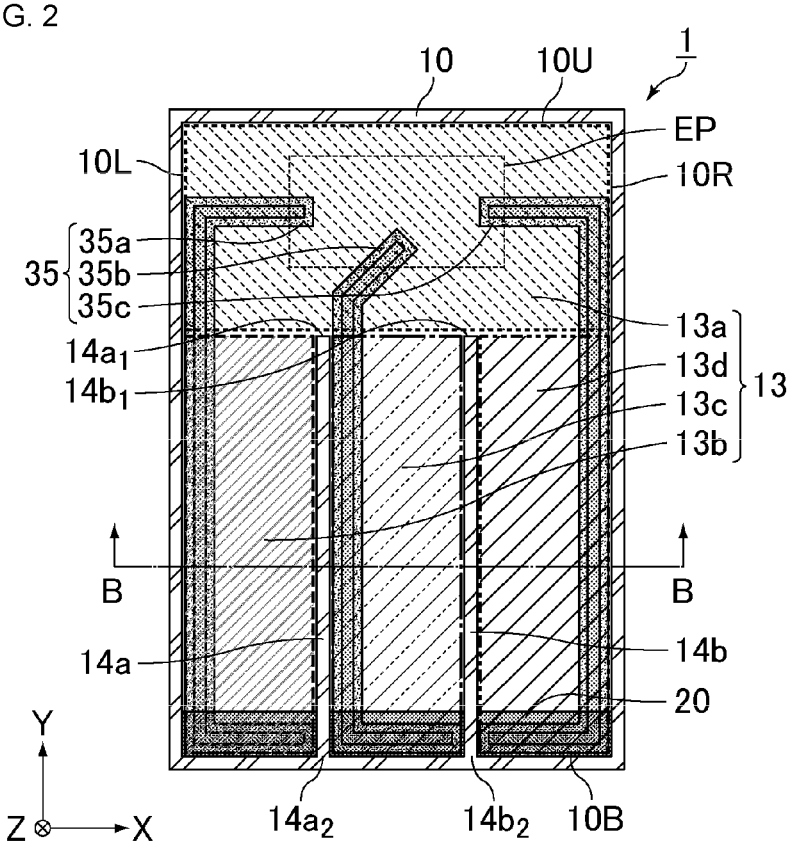
FIG. 2 is a sectional view taken along line A-A of FIG. 1.

FIG. 2 is a sectional view taken along line A-A of FIG. 1.

Figure 3:
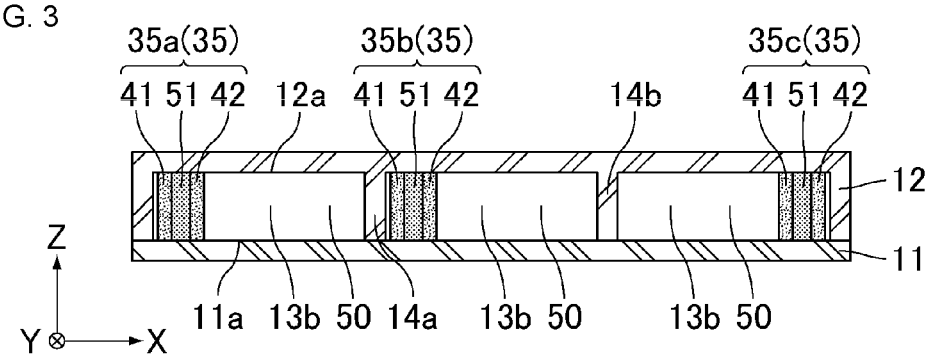
FIG. 3 is a sectional view taken along line B-B of FIG. 2.

FIG. 3 is a sectional view taken along line B-B of FIG. 2.

As shown in FIGS. 2 and 3, the housing 10 of the vapor chamber 1 includes an internal space 13 and is provided with a first inner wall surface 11*a* and a second inner wall surface 12*a* that face each other in the thickness direction Z.

In the following description, for the sake of convenience, a surface on an upper side of the housing 10 in FIG. 2 will be referred to as an upper surface 10U, a surface on a left side will be referred to as a left surface 10L, a surface on a right side will be referred to as a right surface 10R, and a surface on a lower side will be referred to as a bottom surface 10B.

Note that the posture of the vapor chamber 1 of the present invention at the time of use is not particularly limited, and the vapor chamber 1 does not need to be used in a state where the upper surface 10U is on an upper side in a vertical direction.

In addition, all of the upper surface 10U, the left surface 10L, the right surface 10R, and the bottom surface 10B are inner surfaces of the housing 10 that form the internal space 13.

As shown in FIG. 2, a working medium 20 is encapsulated in the internal space 13.

The working medium 20 is not particularly limited as long as the working medium 20 can cause a gas-liquid phase change under the environment inside the housing 10 and water, alcohols, CFC substitutes, and the like can be used as the working medium 20, for example. For example, the working medium is an aqueous compound and is preferably water.

As shown in FIG. 2, an evaporation portion EP for evaporation of the encapsulated working medium 20 is set in a first region 13*a* of the housing 10. A portion of the internal space 13 of the housing 10 that is in the vicinity of the heat source HS and is heated by the heat source HS corresponds to the evaporation portion EP.

As shown in FIG. 2, the internal space 13 includes at least the first region 13*a*, a second region 13*b*, a third region 13*c*, and a fourth region 13*d*.

The first region 13*a* and the second region 13*b* are continuously adjacent to each other.

The first region 13*a* and the third region 13*c* are continuously adjacent to each other.

The first region 13*a* and the fourth region 13*d* are continuously adjacent to each other.

The second region 13*b* and the third region 13*c* are adjacent to each other with a first partition wall 14*a* interposed therebetween, the first partition wall 14*a* being gas-impermeable.

The third region 13*c* and the fourth region 13*d* are adjacent to each other with a second partition wall 14*b* interposed therebetween, the second partition wall 14*b* being gas-impermeable.

The first partition wall 14*a* has a first end portion $\mathbf{14}a_1$ and a second end portion $\mathbf{14}a_2$, the first end portion $\mathbf{14}a_1$ abuts the first region 13*a*, and the second end portion 14*a*2 is connected to the bottom surface 10B.

The second partition wall 14*b* has a first end portion $\mathbf{14}b_1$ and a second end portion $\mathbf{14}b_2$, the first end portion $\mathbf{14}b_1$ abuts the first region 13*a*, and the second end portion $\mathbf{14}b_2$ is connected to the bottom surface 10B.

That is, the second region 13*b* is a region surrounded by the left surface 10L, the bottom surface 10B, and the first partition wall 14*a*. Note that the first region 13*a* and the second region 13*b* are distinguished from each other by a boundary that connects the left surface 10L to the first end portion $\mathbf{14}a_1$ of the first partition wall 14*a* in the shortest distance.

In addition, the third region 13*c* is a region surrounded by the first partition wall 14*a*, the bottom surface 10B, and the second partition wall 14*b*. Note that the first region 13*a* and the third region 13*c* are distinguished from each other by a boundary that connects the first end portion $\mathbf{14}a_1$ of the first partition wall 14*a* to the first end portion $\mathbf{14}b_1$ of the second partition wall 14*b*.

In addition, the fourth region 13*d* is a region surrounded by the second partition wall 14*b*, the bottom surface 10B, and the right surface 10R. Note that the first region 13*a* and the fourth region 13*d* are distinguished from each other by a boundary that connects the first end portion 14$b_1$ of the second partition wall 14*b* to the right surface 10R in the shortest distance.

In addition, the first region 13*a* is a region surrounded by the left surface 10L, the upper surface 10U, and the right surface 10R. Note that the boundaries between the first region 13*a* and each of the second region 13*b*, the third region 13*c* and the fourth region 13*d* are as described above.

Note that, although the first end portion 14$a_1$ of the first partition wall 14*a* and the first end portion 14$b_1$ of the second partition wall 14*b* are formed to be separated from the evaporation portion EP in FIG. 2, in the vapor chamber of the present invention, the first end portions of the partition walls may be disposed to abut the evaporation portion.

As shown in FIG. 3, the first partition wall 14*a* and the second partition wall 14*b* are continuously formed from the first inner wall surface 11*a* to the second inner wall surface 12*a* in the thickness direction Z.

The widths of the first partition wall 14*a* and the second partition wall 14*b* (the widths in the width direction X in FIG. 3) are preferably 200 μm to 1000 μm and more preferably 500 μm to 600 μm.

Preferably, the first partition wall 14*a* and the second partition wall 14*b* are, for example, copper, nickel, aluminum, magnesium, titanium, iron, or alloys containing those materials as main components although there is no particular limit as long as the first partition wall 14*a* and the second partition wall 14*b* are made gas-impermeable. In addition, the first partition wall 14*a* and the second partition wall 14*b* are preferably formed of the same material as the materials of the first sheet 11 and the second sheet 12.

Although the materials of the first partition wall 14*a* and the second partition wall 14*b* may be the same as each other or different from each other, the materials are preferably the same as each other.

In addition, the materials of the first partition wall 14*a* and the second partition wall 14*b* may be the same as the materials of the first sheet 11 and the second sheet 12 and may be different from the materials of the first sheet 11 and the second sheet 12.

The first partition wall 14*a* and the second partition wall 14*b* may be formed by bonding plate materials to each other through laser welding, resistance welding, diffusion bonding, brazing, tungsten-inert gas welding (TIG welding), ultrasonic bonding, or resin bonding.

In addition, the first partition wall 14*a* and the second partition wall 14*b* may be formed by performing etching on the first sheet 11 and the second sheet 12.

In addition, the first partition wall 14*a* and the second partition wall 14*b* may be formed by printing with sintered metal and performing sintering.

As shown in FIG. 2, wicks 35 are disposed in the internal space 13.

The wicks 35 include a first wick 35*a* formed over an area from the first region 13*a* to the second region 13*b*, a second wick 35*b* formed over an area from the first region 13*a* to the third region 13*c*, and a third wick 35*c* formed over an area from the first region 13*a* to the fourth region 13*d*.

The first wick 35*a* is formed along the bottom surface 10B of the second region 13*b* and the left surface 10L.

The second wick 35*b* is formed along the bottom surface 10B of the third region 13*c* and the first partition wall 14*a*.

The third wick 35*c* is formed along the bottom surface 10B of the fourth region 13*d* and the right surface 10R.

The wicks 35 are disposed such that one end portion of each of the first wick 35*a*, the second wick 35*b*, and the third wick 35*c* reaches the evaporation portion EP.

Note that a region in the vicinity of the other end portion of each of the first wick 35*a*, the second wick 35*b*, and the third wick 35*c* is at a position separated from the evaporation portion EP and is a condensation portion in which an evaporated working medium is condensed.

As shown in FIG. 3, each of the first wick 35*a*, the second wick 35*b*, and the third wick 35*c* has a portion that extends in a direction perpendicular to the thickness direction Z, and that abuts the first inner wall surface 11*a* and the second inner wall surface 12*a* of the housing 10.

Each wick 35 includes a first porous body 41 and a second porous body 42. The porous bodies have a function of transferring the working medium 20 by means of capillary attraction.

In addition, each of the first porous body 41 and the second porous body 42 constituting each wick 35 has a portion that abuts the first inner wall surface 11*a* and the second inner wall surface 12*a* of the housing 10. Since the porous bodies are disposed in the internal space 13 of the housing 10, it is possible to absorb an impact from the outside of the housing 10 while securing the mechanical strength of the housing 10.

The thicknesses of the first porous body 41 and the second porous body 42 constituting each wick 35 are substantially the same as the thickness of the internal space 13 of the housing 10.

In the internal space 13 of the housing 10, vapor flow paths 50 through which the working medium 20 in a gas phase flows are formed between the first wick 35*a* and the first partition wall 14*a*, between the second wick 35*b* and the second partition wall 14*b*, and between the third wick 35*c* and the second partition wall 14*b*.

As the first porous body 41 and the second porous body 42, for example, metal porous films formed through etching or metal working, meshes, non-woven fabrics, sintered bodies, and other porous bodies are used. Meshes that are the materials of the wicks may be composed of, for example, metal meshes, resin meshes, surface-coated metal meshes, or surface-coated resin meshes and preferably composed of copper meshes, stainless steel (SUS) meshes, or polyester meshes. Sintered bodies that are the materials of the wicks may be composed of, for example, metal porous sintered bodies or ceramic porous sintered bodies and preferably composed of porous sintered bodies formed of copper or nickel.

Other porous bodies that are the materials of the wicks may be composed of, for example, metal porous bodies, ceramic porous bodies, resin porous bodies, or the like.

Note that porous bodies include meshes, non-woven fabrics, and sintered bodies as well in the present specification.

As shown in FIG. 3, in each wick 35, an interval is provided between the first porous body 41 and the second porous body 42 in a direction in which the first porous body 41 and the second porous body 42 extend so as to form a puddle flow path 51. The puddle flow path 51 can be used as a liquid flow path through which the working medium 20 in a liquid phase flows. In a case where the wick 35 has such a shape, the efficiency of heat transfer can be improved.

Next, effects achieved in a case where the vapor chamber 1 is used will be described.

Although the details will be described later, in the case of a vapor chamber in the related art in which a first partition wall and a second partition wall are not formed, a puddle may be formed in a state of being one-sided to one position depending on the posture of the vapor chamber.

However, in the case of the vapor chamber 1, it is possible to suppress formation of such a puddle that is one-sided to one position.

This effect will be described below with reference to the drawings.

Figure 4:
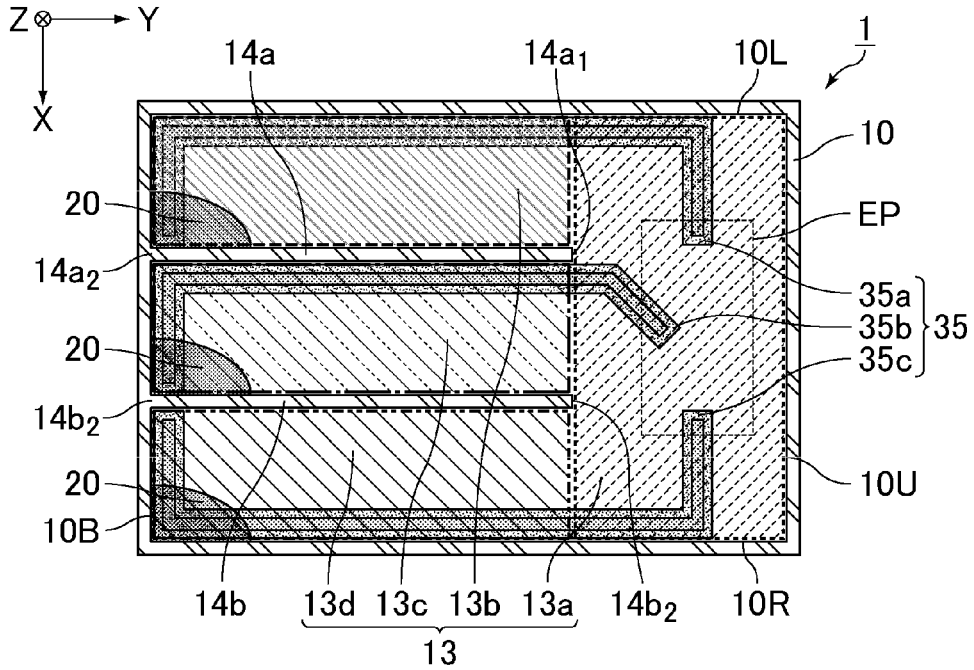
FIG. 4 is a sectional view schematically showing an example of a case where the vapor chamber shown in FIG.

FIG. 4 is a sectional view schematically showing an example of a case where the vapor chamber shown in FIG. 1 is used with the right surface of the housing positioned on a lower side in the vertical direction.

As shown in FIG. 4, in a case where the vapor chamber 1 is used with the right surface of the housing positioned on the lower side in the vertical direction, the working medium 20 in a liquid phase is likely to be accumulated on a connection portion between the bottom surface 10B and the first partition wall 14*a*, a connection portion between the bottom surface 10B and the second partition wall 14*b*, and a connection portion of the right surface 10R.

Such a working medium 20 in the liquid phase is quickly collected by the first wick 35*a*, the second wick 35*b*, and the third wick 35*c*.

That is, in the vapor chamber 1, the working medium 20 in the liquid phase is less likely to be accumulated in a state of being one-sided to one position.

Therefore, the in-plane temperature uniformity of the vapor chamber 1 is maintained, and it is possible to suppress a decrease in maximum amount of heat transfer.

In addition, the working medium 20 in a gas phase moves substantially evenly to the second region 13*b*, the third region 13*c*, and the fourth region 13*d*, although the working medium 20 is affected by the gravity.

Since the first partition wall 14*a* and the second partition wall 14*b* are gas-impermeable, the working medium 20 in the gas phase cannot move between the second region 13*b* and the third region 13*c* through the first partition wall 14*a* and cannot move between the third region 13*c* and the fourth region 13*d* through the second partition wall 14*b*.

Therefore, it is possible to suppress occurrence of the working medium 20 that is one-sided to any one of the second region 13*b*, the third region 13*c*, and the fourth region 13*d*.

That is, a fact that the first partition wall 14*a* and the second partition wall 14*b* are gas-impermeable contributes to maintenance of the in-plane temperature uniformity of the vapor chamber 1.

In addition, in a case where the working medium 20 is water, the first partition wall 14*a* and the second partition wall 14*b* are preferably hydrophobic.

In a case where the first partition wall 14*a* and the second partition wall 14*b* are hydrophobic, water is less likely to adhere to the first partition wall 14*a* and the second partition wall 14*b*. In addition, in a case where the phase of water becomes a liquid phase, the water quickly moves along the first partition wall 14*a* and the second partition wall 14*b*, and is easily collected by each wick.

In the vapor chamber 1 shown in FIG. 2, one first wick 35*a*, one second wick 35*b*, and one third wick 35*c* are disposed in the second region 13*b*, the third region 13*c*, and the fourth region 13*d*, respectively. However, in the vapor chamber according to the first embodiment of the present invention, a plurality of wicks may be disposed in each region.

In a case where a plurality of wicks are disposed, the efficiency of collection of the working medium is improved.

If the number of wicks is too large, the ratio of an area occupied by the vapor flow paths is decreased and thus vapor diffusion pressure loss is made large. As a result, a decrease in maximum amount of heat transfer becomes likely to occur.

A preferable ratio of the wicks to the internal space is as follows.

In the vapor chamber 1, a ratio of the area of the first wick 35*a* to the area of the second region 13*b* in plan view of the internal space 13 as seen in the thickness direction Z is preferably 60% or less and more preferably 30% or less.

In the vapor chamber 1, a ratio of the area of the second wick 35*b* to the area of the third region 13*c* in plan view of the internal space 13 as seen in the thickness direction Z is preferably 60% or less and more preferably 30% or less.

In the vapor chamber 1, a ratio of the area of the third wick 35*c* to the area of the fourth region 13*d* in plan view of the internal space 13 as seen in the thickness direction Z is preferably 60% or less and more preferably 30% or less.

When the ratio of the area of the first wick 35*a* to the area of the second region 13*b* exceeds 60%, the ratio of the area occupied by the vapor flow paths decreases, and the vapor diffusion pressure loss is made large. As a result, a decrease in maximum amount of heat transfer becomes likely to occur.

The same applies to the ratio of the area of the second wick 35*b* to the area of the third region 13*c* and the ratio of the area of the third wick 35*c* to the area of the fourth region 13*d*.

Problems occurring in a case where a vapor chamber in the related art, in which a first partition wall and a second partition wall are not formed, is used will also be described below.

FIG. 5 is a sectional view schematically showing an example of a case where the vapor chamber in the related art is used with a right surface of a housing positioned on a lower side in the vertical direction.

A vapor chamber 1' shown in FIG. 5 has the same configuration as the vapor chamber 1 except that the first partition wall 14*a* and the second partition wall 14*b* are not formed and a first wick 35*a*', a second wick 35*b*', and a third wick 35*c*' are disposed instead of the first wick 35*a*, the second wick 35*b*, and the third wick 35*c*.

The first wick 35*a*', the second wick 35*b*', and the third wick 35*c*' are formed to extend from the evaporation portion EP to the vicinity of the bottom surface 10B.

The vapor flow paths 50 are formed between the left surface 10L and the first wick 35*a*', between the first wick 35*a*' and the second wick 35*b*', between the second wick 35*b*' and the third wick 35*c*', and between the third wick 35*c*' and the right surface 10R.

In a case where the vapor chamber 1' is used in such a posture that the right surface 10R faces the lower side in the vertical direction, the working medium 20 in a liquid phase is one-sided to a connection portion between the bottom surface 10B and the right surface 10R due to the gravity and the pressure of the working medium 20 in a gas phase passing through the vapor flow paths 50 (represented by arrows P in FIG. 5), so that a puddle is formed.

In a case where such a puddle is one-sided, the working medium 20 cannot be collected by the first wick 35*a*' and the second wick 35*b*' although the working medium 20 can be collected by the third wick 35*c*'. Since the temperature around the puddle is low, the in-plane temperature uniformity of the vapor chamber 1' is one-sided.

In such a case, the maximum amount of heat transfer of the vapor chamber 1' is decreased.

Second Embodiment

Next, a vapor chamber, which is a heat diffusion device according to a second embodiment of the present invention, will be described.

FIG. 6 is a sectional view schematically showing an example of the vapor chamber, which is the heat diffusion device according to the second embodiment of the present invention.

In the case of a vapor chamber 101 shown in FIG. 6, the planar shape of a housing 110 as seen in the thickness direction Z is an L-like shape.

In the following description, for the sake of convenience, a surface on an upper side of the housing 110 in FIG. 6 will be referred to as an upper surface 110U, a surface on a left side will be referred to as a left surface 110L, a surface on a right side will be referred to as a right surface 110R, and a surface on a lower side will be referred to as a bottom surface 110B.

The right surface 110R of the housing 110 is formed in a crank-like shape.

Note that the posture of the vapor chamber 101 of the present invention at the time of use is not particularly limited, and the vapor chamber 101 does not need to be used in a state where the upper surface 110U is on an upper side in the vertical direction.

In addition, all of the upper surface 110U, the left surface 110L, the right surface 110R, and the bottom surface 110B are inner surfaces of the housing 110 that form an internal space 113.

As shown in FIG. 6, the internal space 113 includes at least a first region 113*a*, a second region 113*b*, a third region 113*c*, and a fourth region 113*d*.

The first region 113*a* and the second region 113*b* are continuously adjacent to each other.

The first region 113*a* and the third region 113*c* are continuously adjacent to each other.

The first region 113*a* and the fourth region 113*d* are continuously adjacent to each other.

The second region 113*b* and the third region 113*c* are adjacent to each other with a first partition wall 114*a* interposed therebetween, the first partition wall 114*a* being gas-impermeable.

The third region 113*c* and the fourth region 113*d* are adjacent to each other with a second partition wall 114*b* interposed therebetween, the second partition wall 114*b* being gas-impermeable.

The first partition wall 114*a* has a first end portion 114$a_1$ and a second end portion 114$a_2$, the first end portion 114$a_1$ abuts the first region 113*a*, and the second end portion 114$a_2$ is connected to the bottom surface 110B.

The second partition wall 114*b* has a first end portion 114$b_1$ and a second end portion 114$b_2$, the first end portion 114$b_1$ abuts the first region 113*a*, and the second end portion 114$b_2$ is connected to the bottom surface 110B.

That is, the second region 113*b* is a region surrounded by the left surface 110L, the bottom surface 110B, and the first partition wall 114*a*. Note that the first region 113*a* and the second region 113*b* are distinguished from each other by a boundary that connects the left surface 110L to the first end portion 114$a_1$ of the first partition wall 114*a* in the shortest distance.

In addition, the third region 113*c* is a region surrounded by the first partition wall 114*a*, the bottom surface 110B, and the second partition wall 114*b*. Note that the first region 113*a* and the third region 113*c* are distinguished from each other by a boundary that connects the first end portion 114$a_1$ of the first partition wall 114*a* to the first end portion 114$b_1$ of the second partition wall 114*b*.

In addition, the fourth region 113*d* is a region surrounded by the second partition wall 114*b*, the bottom surface 110B, and the right surface 110R. Note that the first region 113*a* and the fourth region 113*d* are distinguished from each other by a boundary that connects the first end portion 114$b_1$ of the second partition wall 114*b* to the right surface 110R in the shortest distance.

In addition, the first region 113*a* is a region surrounded by the left surface 110L, the upper surface 110U, and the right surface 110R. Note that the boundaries between the first region 113*a* and each of the second region 113*b*, the third region 113*c* and the fourth region 113*d* are as described above.

The first partition wall 114*a* and the second partition wall 114*b* are bent such that the working medium 20 in a liquid phase can be moved to the first region 113*a* by the gravity when the upper surface 110U of the vapor chamber 101 is positioned on the lower side in the vertical direction.

That is, the first partition wall 114*a* and the second partition wall 114*b* are formed to be bent toward the evaporation portion EP from the bottom surface 110B.

Wicks 135 are disposed in the internal space 113.

The wicks 135 include a first wick 135*a* formed over an area from the first region 113*a* to the second region 113*b*, a second wick 135*b* formed over an area from the first region 113*a* to the third region 113*c*, and a third wick 135*c* formed over an area from the first region 113*a* to the fourth region 113*d*.

The first wick 135*a* is formed along the bottom surface 110B of the second region 113*b*, the left surface 110L, and a portion of the first partition wall 114*a*.

The second wick 135*b* is formed along the bottom surface 110B of the third region 113*c*, the first partition wall 114*a*, and a portion of the second partition wall 114*b*.

The third wick 135*c* is formed along the bottom surface 110B of the fourth region 113*d* and the right surface 110R.

Next, effects achieved in a case where the vapor chamber 101 is used in such a posture that the bottom surface 110B is positioned on the lower side in the vertical direction will be described.

Since the vapor chamber 101 shown in FIG. 6 is provided with the first partition wall 114*a* and the second partition wall 114*b*, a puddle is less likely to be formed in a state of being one-sided to one position.

In addition, the working medium 20 in the liquid phase formed in the second region 113*b*, the third region 113*c*, and the fourth region 113*d* is quickly collected by the first wick 135*a*, the second wick 135*b*, and the third wick 135*c*.

Therefore, the in-plane temperature uniformity of the vapor chamber 101 is maintained, and it is possible to suppress a decrease in maximum amount of heat transfer.

Problems occurring in a case where a vapor chamber in the related art, in which a first partition wall and a second partition wall are not formed, is used will also be described below.

FIG. 7 is a sectional view schematically showing an example of an internal structure of a vapor chamber in the related art, in which a housing has an L-like shape.

A vapor chamber 101' shown in FIG. 7 has the same configuration as the vapor chamber 101 except that the first partition wall 114*a* and the second partition wall 114*b* are not formed and a first wick 135*a*', a second wick 135*b*', and a third wick 135*c*' are disposed instead of the first wick 135*a*, the second wick 135*b*, and the third wick 135*c*.

The first wick 135*a*' is formed to extend from the evaporation portion EP to the vicinity of the bottom surface 110B.

The second wick 135*b*' is formed to extend toward the bottom surface 110B from the evaporation portion EP, to be bent at an intermediate position, and to extend to the vicinity of a connection portion between the bottom surface 110B and the right surface 110R.

The third wick 135*c*' is formed along the right surface 110R in a crank-like shape.

The vapor flow paths 50 are formed between the first wick 135*a*' and the second wick 135*b*' and between the second wick 135*b*' and the third wick 135*c*'.

In a case where the vapor chamber 101' is used in such a posture that the bottom surface 110B is positioned on the lower side in the vertical direction, the working medium 20 in a liquid phase is one-sided to a connection portion between the bottom surface 110B and the right surface 110R due to the gravity and the pressure of the working medium 20 in a gas phase passing through the vapor flow paths 50 (represented by arrows P in FIG. 7), so that a puddle is formed.

In a case where such a puddle is one-sided, the working medium 20 cannot be collected by the first wick 135*a*' although the working medium 20 can be collected by the second wick 135*b*' and the third wick 135*c*'. Since the temperature around the puddle is low, the in-plane temperature uniformity of the vapor chamber 101' is one-sided.

In such a case, the maximum amount of heat transfer of the vapor chamber 101' is decreased.

Next, a case where the vapor chamber 101 or the vapor chamber 101' is used such that the right surface 110R is positioned on the lower side in the vertical direction will be described.

FIG. 8 is a sectional view schematically showing an example of a case where the vapor chamber, which is the heat diffusion device according to the second embodiment of the present invention, is used with the right surface of the housing positioned on the lower side in the vertical direction.

FIG. 9 is a sectional view schematically showing an example of a case where the vapor chamber in the related art in which the housing has the L-like shape is used with the right surface of the housing positioned on the lower side in the vertical direction.

As shown in FIG. 8, in a case where the vapor chamber 101 is used such that the right surface 110R is positioned on the lower side in the vertical direction, the working medium in a liquid phase is likely to be accumulated on a connection portion between the bottom surface 110B and the first partition wall 114*a*, a connection portion between the bottom surface 110B and the second partition wall 114*b*, and a connection portion between the bottom surface 110B and the right surface 110R.

Such a working medium 20 in the liquid phase is quickly collected by the first wick 135*a*, the second wick 135*b*, and the third wick 135*c*.

That is, in the vapor chamber 101, the working medium 20 in the liquid phase is less likely to be accumulated in a state of being one-sided to one position.

Therefore, the in-plane temperature uniformity of the vapor chamber 101 is maintained, and it is possible to suppress a decrease in maximum amount of heat transfer.

Meanwhile, in a case where the vapor chamber 101' is used such that the right surface 110R is positioned on the lower side in the vertical direction as shown in FIG. 9, the working medium 20 in a liquid phase is one-sided to a connection portion between the bottom surface 110B and the right surface 110R due to the gravity and the pressure of the working medium 20 in a gas phase passing through the vapor flow paths 50 (represented by arrows P in FIG. 9), so that a puddle is formed.

In a case where such a puddle is one-sided, the working medium 20 cannot be collected by the first wick 135*a*' and the second wick 135*b*' although the working medium 20 can be collected by the third wick 135*c*'. Since the temperature around the puddle is low, the in-plane temperature uniformity of the vapor chamber 101' is one-sided.

In such a case, the maximum amount of heat transfer of the vapor chamber 101' is decreased.

Other Embodiments

In the vapor chamber, which is the heat diffusion device according to the first embodiment of the present invention, the partition wall is formed as an integral wall and is formed to continue from the first inner wall surface to the second inner wall surface in the thickness direction.

However, in the vapor chamber, which is the heat diffusion device according to the present invention, the partition wall may be formed by two walls that are a wall formed on the first inner wall surface and a wall formed on the second inner wall surface.

In addition, in the vapor chamber, which is the heat diffusion device according to the present invention, the partition wall may be formed in the thickness direction from the first inner wall surface to the second inner wall surface and the partition wall may be provided with a discontinuation region between the first inner wall surface and the second inner wall surface.

An example of such a partition wall will be described with reference to the drawings.

FIGS. 10A to 10D are sectional views schematically showing an example of a partition wall of the vapor chamber, which is the heat diffusion device according to the present invention.

A partition wall 214 shown in FIG. 10A includes a partition wall 214A that is formed in the thickness direction Z from the first inner wall surface 11*a* toward the second inner wall surface 12*a* and a partition wall 214B that is formed in the thickness direction Z from the second inner wall surface 12*a* toward the first inner wall surface 11*a*.

A position where the partition wall 214A is formed and a position where the partition wall 214B is formed are offset from each other in the width direction X and the partition wall 214A and the partition wall 214B are in contact with each other.

A partition wall 314 shown in FIG. 10B is formed in the thickness direction Z from the first inner wall surface 11*a* toward the second inner wall surface 12*a* and a discontinuation region 315 is formed between an end portion of the partition wall 314 and the second inner wall surface 12*a*.

A partition wall 414 shown in FIG. 10C includes a partition wall 414A that is formed in the thickness direction Z from the first inner wall surface 11*a* toward the second inner wall surface 12*a* and a partition wall 414B that is formed in the thickness direction Z from the second inner wall surface 12*a* toward the first inner wall surface 11*a*.

A discontinuation region 415 is formed between an end portion of the partition wall 414A and an end portion of the partition wall 414B.

A position where the partition wall 414A is formed and a position where the partition wall 414B is formed are the same as each other in the width direction X.

A partition wall 514 shown in FIG. 10D includes a partition wall 514A that is formed in the thickness direction Z from the first inner wall surface 11*a* toward the second inner wall surface 12*a* and a partition wall 514B that is formed in the thickness direction Z from the second inner wall surface 12*a* toward the first inner wall surface 11*a*.

A position where the partition wall 514A is formed and a position where the partition wall 514B is formed are offset from each other in the width direction X.

A discontinuation region 515 is formed between the partition wall 514A and the partition wall 514B.

Even if a discontinuation region is formed as shown in FIGS. 10B to 10D, the partition wall has an effect of suppressing accumulation of a working medium on one position.

Therefore, even in the case of such a vapor chamber, a decrease in maximum amount of heat transfer is less likely to occur.

In the vapor chamber which is the heat diffusion device according to the first embodiment of the present invention and the vapor chamber which is the heat diffusion device according to the second embodiment of the present invention, the internal space of the housing is formed by the first region, the second region, the third region, and the fourth region.

However, in the vapor chamber which is the heat diffusion device of the present invention, the internal space of the housing may be formed only by the first region, the second region, and the third region.

In addition, in the vapor chamber which is the heat diffusion device of the present invention, the internal space of the housing may further include another region.

Note that the other region is continuously adjacent to the first region and is adjacent to still another region with a partition wall interposed therebetween. In addition, in the other region, a wick is formed over an area from the first region to the other region.

[Electronic Device Provided with Vapor Chamber]

The vapor chamber, which is the heat diffusion device of the present invention, can be mounted in an electronic device for the purpose of dissipating heat. Therefore, the vapor chamber can be used in the form of an electronic device including the vapor chamber, which is the heat diffusion device of the present invention, and an electronic component attached to an outer wall surface of a housing constituting the vapor chamber.

As described above, the vapor chamber, which is the heat diffusion device of the present invention, independently operates without external power and heat can be two-dimensionally diffused at a high speed by means of latent heat of evaporation and latent heat of condensation of a working medium. Therefore, with the electronic device including the vapor chamber which is the heat diffusion device of the present invention, it is possible to effectively achieve heat dissipation in a limited space in the electronic device.

The electronic component corresponds to the heat source HS shown in FIG. 1.

Examples of the electronic device include a smartphone, a tablet terminal, a notebook computer, a game machine, a wearable device, and the like. In addition, examples of the electronic component which is a target to be cooled include a heat generating element such as a central processing unit (CPU), a light emitting diode (LED), and a power semiconductor.

The electronic component may be directly attached to the outer wall surface of the housing and may be attached to the outer wall surface with another member such as a high-thermal-conductivity pressure sensitive adhesive, a high-thermal-conductivity sheet, or a high-thermal-conductivity tape interposed therebetween.

The vapor chamber, which is the heat diffusion device of the present invention, can be used for a wide range of purposes of use in the field of portable information terminals or the like. For example, the vapor chamber can be used to lengthen a time, for which an electronic device is used, by decreasing the temperature of a heat source such as a CPU and can be used for a smartphone, a tablet terminal, a notebook computer, and the like.

REFERENCE SIGNS LIST

1, 1', 101, 101' vapor chamber
10, 110 housing
10U, 110U upper surface
10L, 110L left surface
10R, 110R right surface
10B, 110B bottom surface
11 first sheet
11*a* first inner wall surface
12 second sheet
12*a* second inner wall surface
13, 113 internal space
13*a*, 113*a* first region
13*b*, 113*b* second region
13*c*, 113*c* third region
13*d*, 113*d* fourth region
14*a*, 114*a* first partition wall
14$a_1$, 114$a_1$ first end portion of first partition wall
14$a_2$, 114$a_2$ second end portion of first partition wall
14*b*, 114*b* second partition wall
14$b_1$, 114$b_1$ first end portion of second partition wall
14$b_2$, 114$b_2$ second end portion of second partition wall
20 working medium
35, 135 wick
35*a*, 35*a'*, 135*a*, 135*a'* first wick
35*b*, 35*b'*, 135*b*, 135*b'* second wick
35*c*, 35*c'*, 135*c*, 135*c'* third wick
41 first porous body
42 second porous body
50 vapor flow path
51 puddle flow path
214, 214A, 214B, 314, 414, 414A, 414B, 514, 514A, 514B partition wall
315, 415, 515 discontinuation region

The invention claimed is:

1. A heat diffusion device comprising:

a housing that defines an internal space and has a first inner wall surface and a second inner wall surface that face each other in a thickness direction of the housing;

a working medium encapsulated in the internal space;

a first wick and a second wick in the internal space, wherein each of the first wick and the second wick has a portion that extends in a direction perpendicular to the thickness direction, and that abuts the first inner wall surface and the second inner wall surface of the housing; and a partition wall that is gas-impermeable positioned in the internal space such that, in a plan view of the internal space in the thickness direction, the partition wall is interposed between the first wick and the second wick, and the partition wall has a first end portion and a second end portion, the second end portion of the partition wall being connected to an inner surface of the housing that connects the first inner wall surface to the second inner wall surface so as to define a vapor flow path in the internal space of the housing between at least one of the first wick and the partition wall or the second wick and the partition wall.

2. The heat diffusion device according to claim 1, wherein, in the plan view of the internal space in the thickness direction, the internal space includes at least a first region, a second region, and a third region, the first region and the second region are continuously adjacent to each other, the first region and the third region are continuously adjacent to each other, the second region and the third region are adjacent to each other with the partition wall interposed therebetween, the first end portion of the partition wall abuts the first region, the first wick is positioned over an area from the first region to the second region, and the second wick is positioned over an area from the first region to the third region.

3. The heat diffusion device according to claim 2, wherein the partition wall is continuous from the first inner wall surface to the second inner wall surface in the thickness direction.

4. The heat diffusion device according to claim 1, wherein the partition wall is continuous from the first inner wall surface to the second inner wall surface in the thickness direction.

5. The heat diffusion device according to claim 2, wherein the partition wall extends in the thickness direction from the first inner wall surface to the second inner wall surface, and the partition wall includes a discontinuation region between the first inner wall surface and the second inner wall surface.

6. The heat diffusion device according to claim 1, wherein the partition wall extends in the thickness direction from the first inner wall surface to the second inner wall surface, and the partition wall includes a discontinuation region between the first inner wall surface and the second inner wall surface.

7. The heat diffusion device according to claim 2, wherein a ratio of an area of the first wick to an area of the second region is 60% or less in the plan view of the internal space in the thickness direction.

8. The heat diffusion device according to claim 7, wherein a ratio of an area of the second wick to an area of the third region is 60% or less in the plan view of the internal space in the thickness direction.

9. The heat diffusion device according to claim 2, wherein a ratio of an area of the second wick to an area of the third region is 60% or less in the plan view of the internal space in the thickness direction.

10. The heat diffusion device according to claim 1, wherein the first wick includes a first porous body and a second porous body, and in the first wick, an interval is defined between the first porous body and the second porous body in a direction in which the first porous body and the second porous body extend so as to form a first puddle flow path.

11. The heat diffusion device according to claim 10, wherein the second wick includes a third porous body and a fourth porous body, and in the second wick, an interval is defined between the third porous body and the fourth porous body in a direction in which the third porous body and the fourth porous body extend so as to form a second puddle flow path.

12. The heat diffusion device according to claim 1, wherein the partition wall is a first partition wall, the vapor flow path is a first vapor flow path between the first wick and the first partition wall, and the heat diffusion device further comprises:

a third wick in the internal space, the third wick having a portion that extends in a direction perpendicular to the thickness direction, and that abuts the first inner wall surface and the second inner wall surface of the housing; and a second partition wall that is gas-impermeable positioned in the internal space such that, in the plan view of the internal space in the thickness direction, the second partition wall is interposed between the second wick and the third wick, and the second partition wall has a first end portion and a second end portion, the second end portion of the second partition wall being connected to the inner surface of the housing so as to define a second vapor flow path in the internal space of the housing between the second wick and the second partition wall and define a third vapor flow path in the internal space of the housing between the third wick and the second partition wall.

13. The heat diffusion device according to claim 12, wherein, in the plan view of the internal space in the thickness direction, the internal space includes at least a first region, a second region, a third region, and a fourth region, the first region and the second region are continuously adjacent to each other, the first region and the third region are continuously adjacent to each other, the first region and the fourth region are continuously adjacent to each other, the second region and the third region are adjacent to each other with the first partition wall interposed therebetween, the third region and the fourth region are adjacent to each other with the second partition wall interposed therebetween, the first end portion of the first partition wall abuts the first region, the first end portion of the second partition wall abuts the first region, the first wick is positioned over an area from the first region to the second region, the second wick is positioned over an area from the first region to the third region, and the third wick is positioned over an area from the first region to the fourth region.

14. The heat diffusion device according to claim 13, wherein the first partition wall and the second partition wall are continuous from the first inner wall surface to the second inner wall surface in the thickness direction.

15. The heat diffusion device according to claim 12, wherein the first partition wall and the second partition wall are continuous from the first inner wall surface to the second inner wall surface in the thickness direction.

16. The heat diffusion device according to claim 13, wherein the first partition wall and the second partition wall extend in the thickness direction from the first inner wall surface to the second inner wall surface, and the first partition wall and the second partition wall each include a discontinuation region between the first inner wall surface and the second inner wall surface.

17. The heat diffusion device according to claim 12, wherein the first partition wall and the second partition wall extend in the thickness direction from the first inner wall surface to the second inner wall surface, and the first partition wall and the second partition wall each include a discontinuation region between the first inner wall surface and the second inner wall surface.

18. The heat diffusion device according to claim 12, wherein the first wick includes a first porous body and a second porous body, and in the first wick, an interval is defined between the first porous body and the second porous body in a direction in which the first porous body and the second porous body extend so as to form a first puddle flow path.

19. The heat diffusion device according to claim 18, wherein the second wick includes a third porous body and a fourth porous body, and in the second wick, an interval is defined between the third porous body and the fourth porous body in a direction in which the third porous body and the fourth porous body extend so as to form a second puddle flow path.

20. The heat diffusion device according to claim 19, wherein the third wick includes a fifth porous body and a sixth porous body, and in the third wick, an interval is defined between the fifth porous body and the sixth porous body in a direction in which the fifth porous body and the sixth porous body extend so as to form a third puddle flow path.

* * * * *